United States Patent [19]

Schulz

[11] Patent Number: 4,663,905

[45] Date of Patent: May 12, 1987

[54] SKYLIGHT ASSEMBLY

[76] Inventor: Kenneth Schulz, 400 E. 58th St., New York, N.Y. 10022

[21] Appl. No.: 902,929

[22] Filed: Sep. 2, 1986

[51] Int. Cl.[4] ..... E06B 3/26

[52] U.S. Cl. ..... 52/202; 52/58; 52/72; 49/71

[58] Field of Search ..... 52/58, 63, 72, 200, 52/202, 207, 209, 173 DS; 49/325, 337, 371, 71

[56] References Cited

U.S. PATENT DOCUMENTS

| | | | |
|---|---|---|---|
| 1,145,568 | 6/1915 | Dardano | 49/71 X |
| 1,732,870 | 10/1929 | Weaver | 49/71 X |
| 2,392,678 | 1/1946 | Loetscher | 49/71 |
| 4,589,239 | 5/1986 | Cummings | 52/72 X |
| 4,610,116 | 9/1986 | Schulz | 52/72 X |

FOREIGN PATENT DOCUMENTS

| | | | |
|---|---|---|---|
| 578247 | 1/1933 | Fed. Rep. of Germany | 49/71 |
| 1251492 | 10/1971 | United Kingdom | 49/71 |

*Primary Examiner*—William F. Pate, III

*Assistant Examiner*—Creighton Smith

*Attorney, Agent, or Firm*—Alan H. Levine

[57] ABSTRACT

A skylight assembly for installation in an opening in the pitched roof of a building, comprising a window hinged at one end with respect to the roof, and a rubbery flashing member for maintaining a water-tight seal between the window and roof. The flashing member includes a planar portion for attachment to the roof, beneath the shingles, in an area adjacent to the opening, a portion for attachment to each side of the window, and a gusset portion between each attachment portion and the planar portion. The gusset portion expands and contracts as the window is opened and closed, respectively. All the portions of the flashing member are integrally formed at one piece. The gussets may be accordian-folded and may taper toward the hinged end of the window. The attachment portions of the flashing may be sandwiched between the window pane and window frame to serve as a gasket between those parts of the window.

5 Claims, 6 Drawing Figures

SKYLIGHT ASSEMBLY

This invention relates to skylights for buildings, and more particularly to a skylight for use in the pitched roof of a building.

A major problem associated with conventional roof skylights involves leakage of rainwater around the skylight, or between the movable skylight window and the stationary frame on which it is supported, into the interior of the building. Most skylights rely on individual flashings or seals between the skylight frame and the roof, as well as individual gaskets or seals around the window, to prevent such leakage. However, for various reasons these conventional seals do not always perform satisfactorily.

In copending application Ser. No. 577,681, filed Feb. 7, 1984, now U.S. Pat. No. 4,610,116, this problem is dealt with by providing a skylight assembly employing no seals. Instead, two flashings are furnished, one for directing water flowing down the roof on to the skylight window, and the other flashing for directing water flowing down the window on to a portion of the roof below the window. While this arrangement performs satisfactorily, in certain circumstances a different approach is useful.

It is an object of the invention to provide a skylight assembly incorporating a flashing member of special character capable of providing a unitary seal across the seam between the skylight frame and the roof as well as between the movable window and the skylight frame which supports it.

It is another object of the invention to provide such a skylight assembly wherein a portion of the flashing member can also serve as a gasket between the window pane and the window frame in which it is mounted.

It is a further object of the invention to provide such a skylight assembly wherein the flashing member continues to serve as a seal between the window and the skylight frame even when the window is open.

It is an additional object of the invention to provide such a skylight assembly which can be packaged as a ready-to-install unit with a prefinished interior, for mounting within a properly sized pre-cut opening in a roof.

Additional objects and features of the invention will be apparent from the following description, in which reference is made to the accompanying drawings. In the drawings.

A skylight assembly according to the invention is intended to be installed within a pre-cut rectangular opening in the pitched roof of a building. The roof is illustrated as comprising parallel rafters 10 (FIGS. 4 and 5), plywood or other type of board 12 secured to the outer edges of the rafters, and shingles 13 covering the outer face of the board 12. In making the opening in the roof, the shingles 13 have been cut through or removed, and a rectangular hole cut in the board 12. A section of a rafter 11 (FIGS. 2 and 3), parallel to rafters 10, has also been removed in this example. However, no rafter need be cut if the skylight is sized to fit between two successive rafters.

Figure 2:
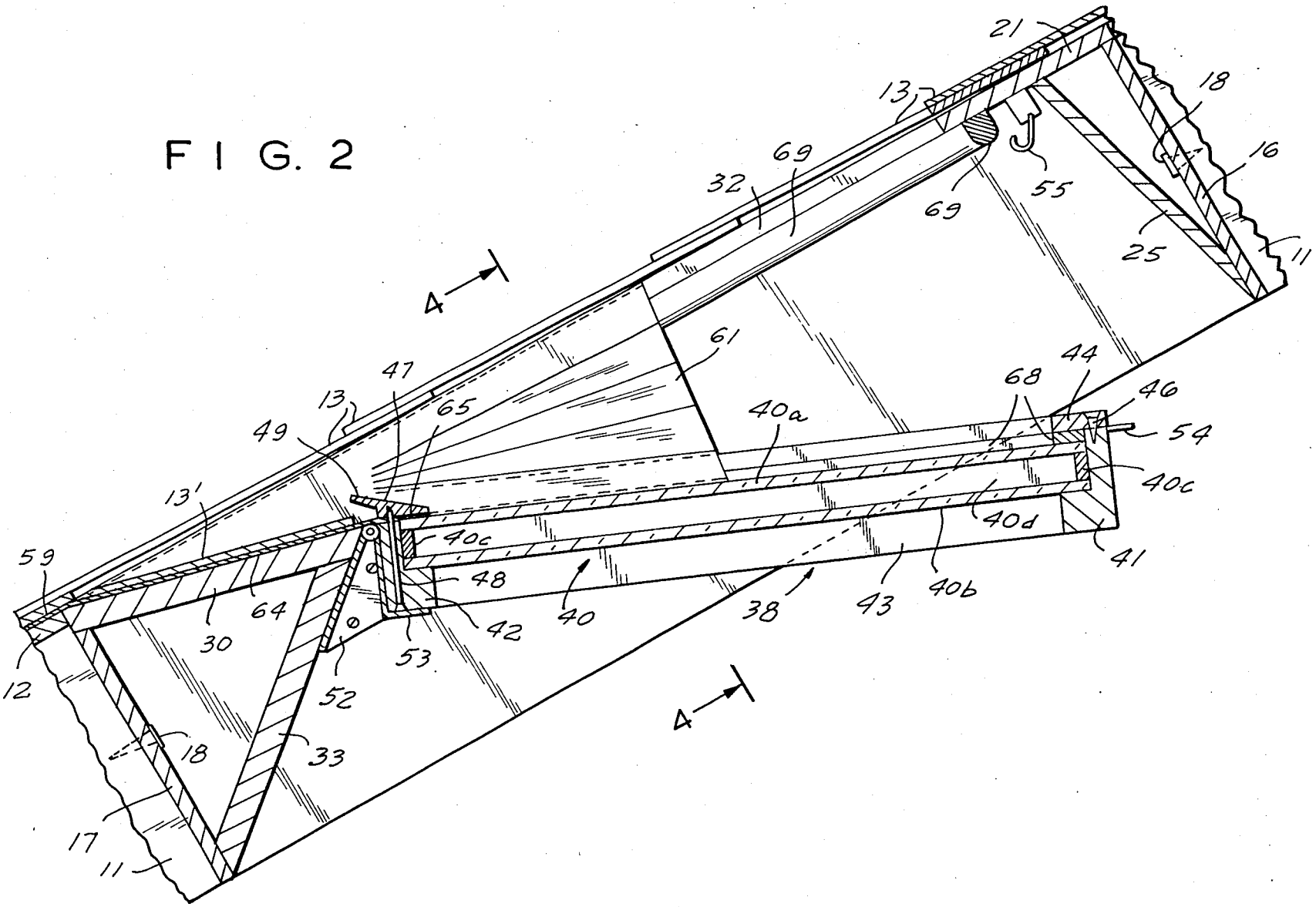
FIG. 2 is a cross-sectional view taken along line 2—2 of FIG. 1.
Figure 3:
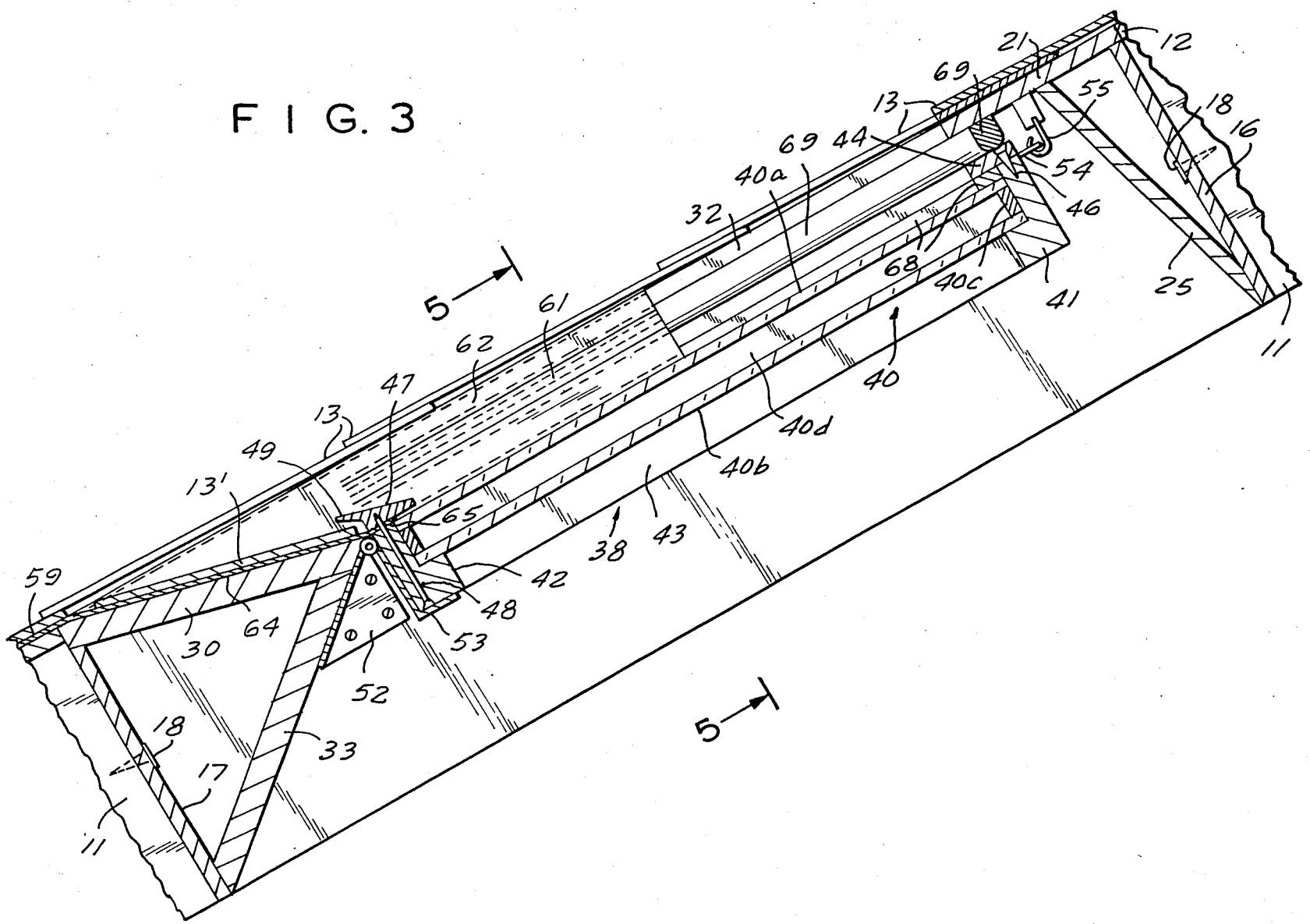
FIG. 3 is a view similar to FIG. 2, with the window closed.

The skylight assembly chosen to illustrate the present invention includes a rectangular frame having a size about equal to that of the opening provided in the roof, the frame fitting between rafters 10 and between the cut ends of rafter 11. The skylight frame includes two side members 14 (FIGS. 4 and 5), an upper cross-member 16, and a lower cross member 17 (FIGS. 2 and 3). The cross-members are fixed to the upper and lower ends, respectively, of side members 14. When the frame is installed, side members 14 are arranged against opposed faces of rafters 10 and fixed to those rafters, such as by nails 15. In addition, upper cross-member 16 and lower cross-member 17 are fixed to the upper and lower cut ends of the rafter 11, respectively, such as by nails 18. As indicated in FIG. 2, the outer edges of frame side members 14 and cross-members 16 and 17 are installed flush with the outer edges of rafters 10 and 11. (As used herein, the terms "inner" and "outer" refer to the interior and exterior of the building, the exterior being at the upper left in FIG. 2; the terms "upper" and "lower" refer to the direction of water flow down the inclined roof from an upper point at the right in FIG. 2 to a lower point at the left.)

A panel 21 (FIGS. 2 and 3), similar in thickness to the thickness of roof boards 12, overlies the outer edges of cross-member 16 and side members 14, at the upper end of the skylight frame, and is secured to the frame. A decorative oblique panel 25 is secured to panel 21 and to cross-member 16, the panel extending across the entire width of the skylight frame. An inclined panel 30 (FIGS. 2 and 3), extending between frame side members 14, is fixed to cross-member 17 and at its ends to side members 14. While panel 30 is oriented more toward the horizontal than the skylight frame and the roof, it is still inclined downwardly from right to left in FIGS. 2 and 3. A decorative oblique panel 33 is secured to cross-member 17 and to panel 30, the panel 33 extending across the entire width of the skylight frame. It will be appreciated that the oblique panels 25 and 33 give a decorative finished appearance to the interior of the skylight. Narrow panels 32, similar in thickness to the thickness of roof boards 12, are mounted on the outer faces of frame side members 14 (FIGS. 4 and 5).

Arranged in the region between the side members 14 and generally between the oblique panels 25 and 33 is a skylight window 38 (FIGS. 1–5). The window includes a frame within which the edges of a transparent or translucent window pane 40 are supported. Pane 40 is preferably of the insulated glass type, comprising two panes **40*a* and 40*b*, separated by spacers 40*c* to enclose an evacuated region 40*d*** between the two panes.

The window frame includes four strips each having an L-shaped cross-section, one strip 41 being at the upper end of the window, a strip 42 being at the lower end of the window, and strips 43 being at the two sides of the window. The window frame also includes a flat strip 44, secured to the outer edge or strip 41, and flat strips 45 secured to the outer edges of strips 43. Flat strips 44 and 45 may be secured to their respective L-shaped strips by screws 46. The window frame further includes a strip 47 (FIGS. 1, 2, and 3), secured to the outer edge of strip 42 by screws 48. Strip 47 is undercut along its lower edge to provide an overhanging lip 49.

Figure 1:
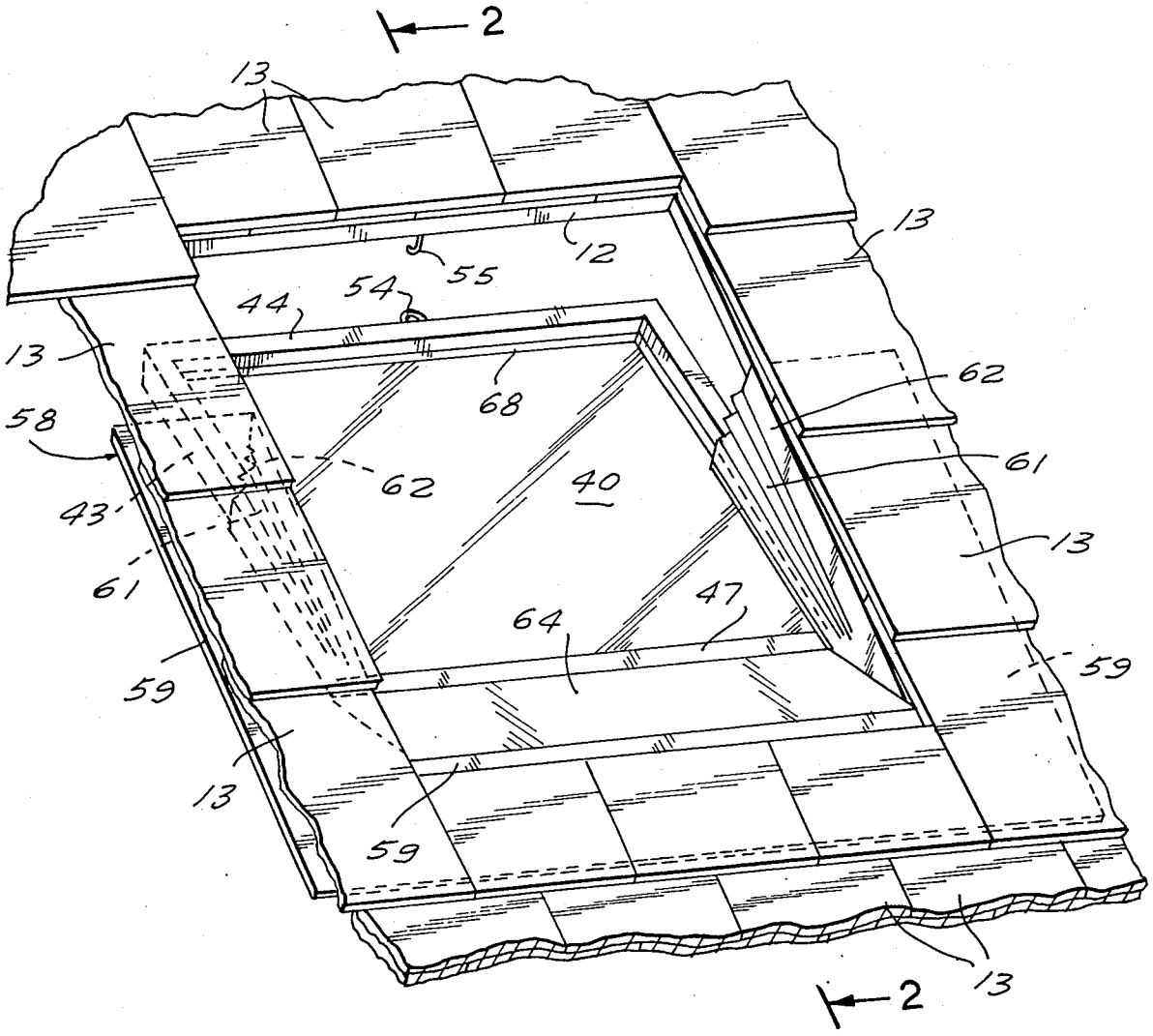
FIG. 1 is a perspective view of a skylight assembly according to the invention installed in an opening in the pitched roof of a building, the window being open.
Figure 4:
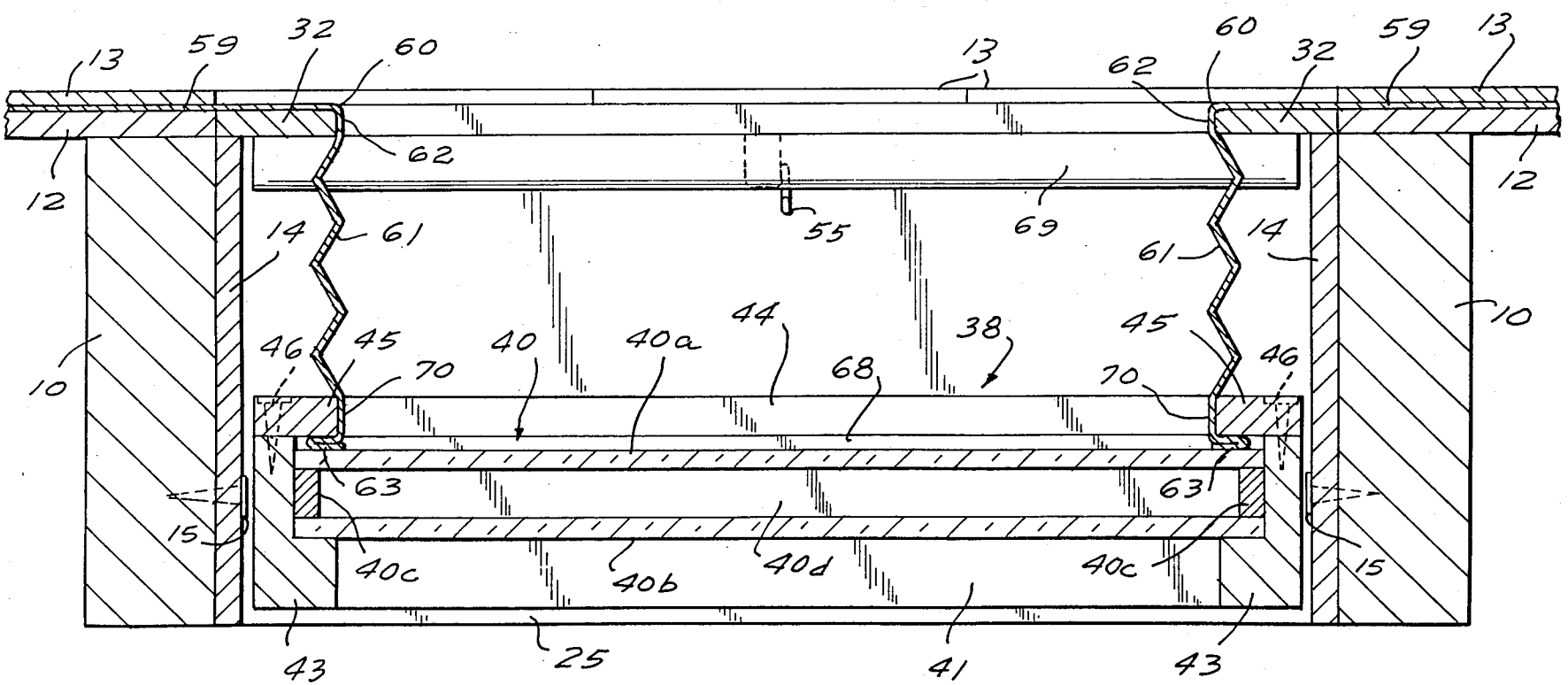
FIG. 4 is a cross-sectional view taken along line 4—4 of FIG. 2.
Figure 5:
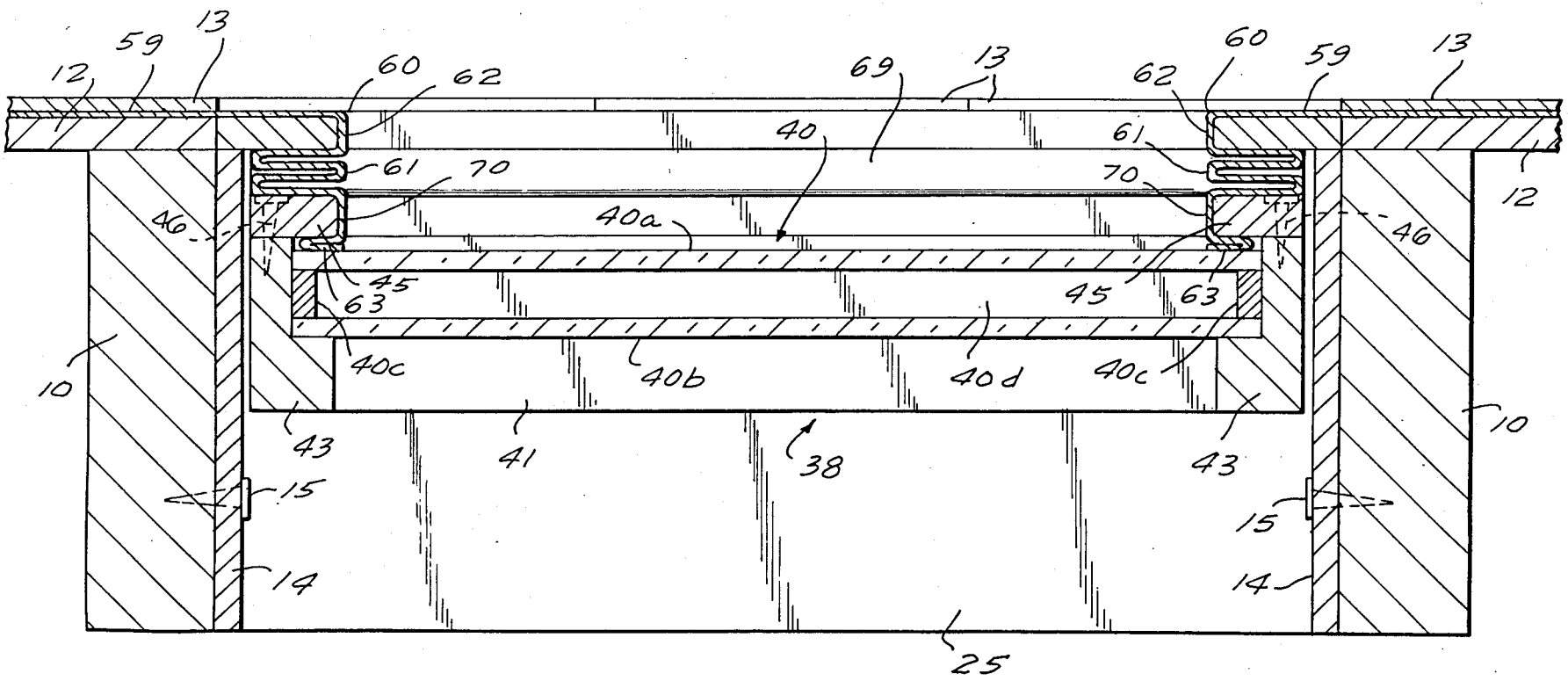
FIG. 5 is a cross-sectional view taken along line 5—5 of FIG. 3.

Window 38 is arranged to be swung between an open position, shown in FIGS. 1, 2, and 4,and a closed position, shown in FIGS. 3 and 5. Mounting of the window for such movement may be effected by hinges including brackets 52 (FIGS. 2 and 3), fastened to side members 14 of the main frame, and brackets 53, fastened to strip 42 at the lower end of the window. Any suitable means, such as an eyelet 54, projecting from window frame strip 41, and a hook 55, depending from panel 21, may be employed to maintain the window closed, when desired.

Figure 6:
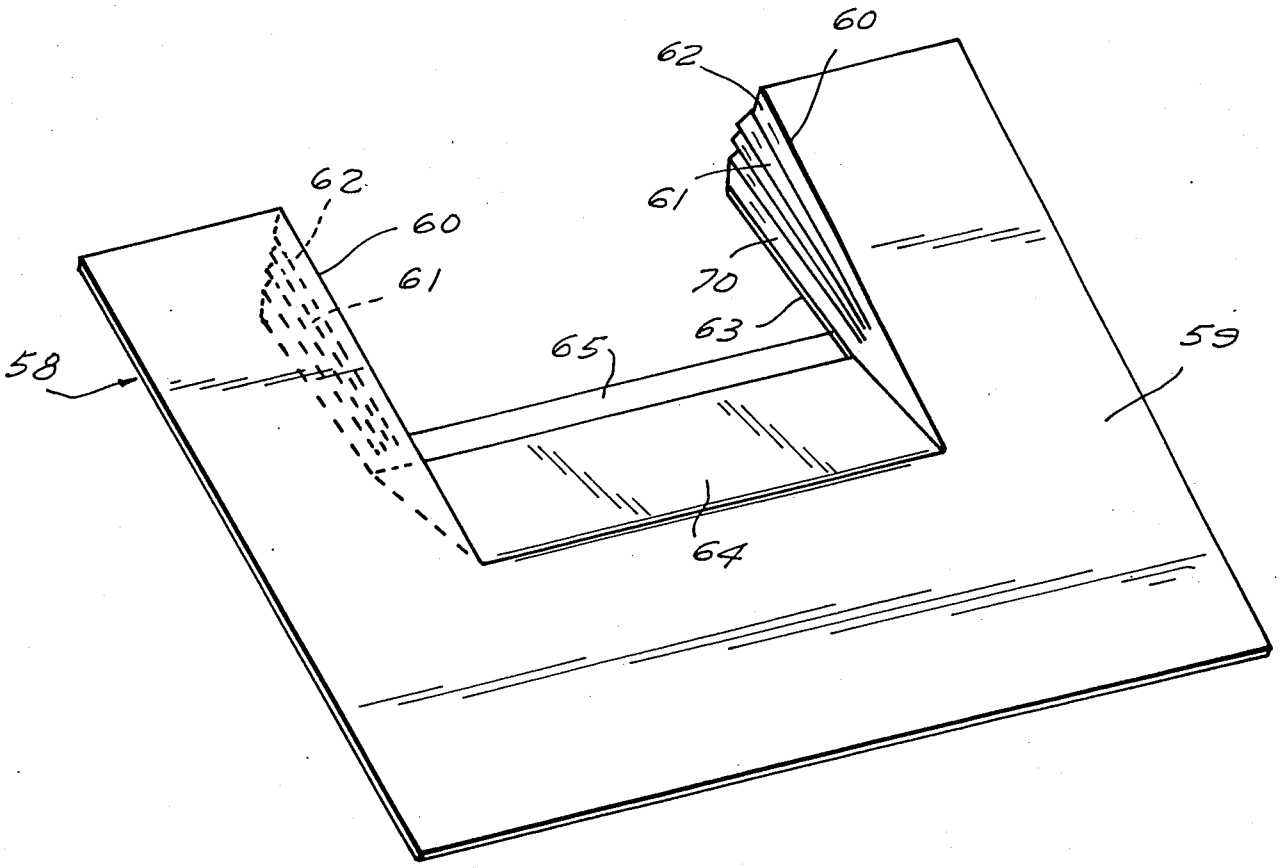
FIG. 6 is a perspective view of a flashing member according to the invention.

According to the invention, a flashing 58 of special character, best seen in FIG. 6, is assembled with the main frame 14, 16, 17, and window 38. Flashing 58 is fabricated of a flexible and resilient material. Any suitable material having the requisite rubbery characteristic may be employed, such as natural rubber, neoprene, or a synthetic substance. Flashing 58 is ssentially a sheet, one illustrative form thereof being shown in FIG. 6.

Flashing 58 includes a generally U-shaped planar portion 59, which in use is placed upon the roof boards 12 and panels 32 so to encircle the lower region of the roof opening and the skylight frame within the opening (see FIG. 1). Extending inwardly from each of the opposed edges 60 of the planar portion is a narrow section 62 which hugs the edge of narrow panel 32. Extending inwardly from each section 62 of flashing 58 is an accordian-folded gusset portion 61, each gusset having a shape which tapers toward the lower hinged end of window 38. Along its innermost edge, each gusset portion is formed with a reversely-folded portion 63 squeezed between the side edges of pane 40 and the window frame strips 45. Flashing portions 63 serve both to attach the inner edges of the gussets 61 to the window, and also as gaskets for sealing those portions of the joints between the pane 40 and window frame in which the gaskets are located.

Extending from planar portion 59 of flashing 58, between gusset portions 61, is a ramp portion 64, along the upper end of which is a lip portion 65. Ramp portion 64 overlies the outer surface of panel 30 (FIGS. 2 and 3), and lip portion 65 overlies the outer surface of frame strip 42, the lip being squeezed between strips 42 and 47. Lip 65 thereby serves as a seal to prevent water flowing down window pane 40 from entering between window frame strips 42 and 47. Instead, such water flows over the outer surface of strip 47 on to the ramp portion 64 of the flashing. For esthetic reasons, it may be desirable to overlay ramp portion 64 with shingles 13' (shown in FIGS. 2 and 3, but omitted in FIG. 1), in which case water flowing off window 38 will flow on to shingles 13'. The undercut in strip 47 accommodates the upper edges of shingles 13', so that lip 49 extends over the joint between shingles 13' and strip 47 to insure that water flow over the outer surface of the shingles.

Since portion 63 of flashing 58 extends within only a portion of the length of the space between window pane 40 and window frame strip 45, an additional gasket 68 (FIGS. 2 and 3) is employed to seal the remainder of that space, as well as to seal the space between pane 40 and window frame strip 44. It may be desirable to use another flashing element (not shown) at the upper region of the roof opening. This flashing element can be similar to the upper flashing member illustrated and described in the previously-mentioned U.S. Pat. No. 4,610,116, which includes a U-shaped planar portion surrounding the upper region of the roof opening and skylight frame, and an inwardly projecting portion consisting of three walls extending inwardly from the planar portion. The inner edges of the walls reach a level within the confines of the top and sides of the window frame. Any additional seals which appear desirable may also be employed. For example, gasketing 69 (FIGS. 2 and 3) may be secured to the lower faces of panels 21 and 32 for engaging the upper surfaces of window frame strips 44 and 45 in the regions where gussets 61 are not present. If desired, planar portion 59, gussets 61, and portion 63 of flashing 58 could extend for the full length of window 38, in which case gaskets 68 and 69 would be shortened to occupy only the regions not occupied by portions 63 and gussets 61, respectively.

Flashing 58 is integrally formed, preferably by a molding operation, so that all its portions are parts of a single unitary piece of material. It will be appreciated that when the flashing is in place, as shown in FIGS. 1–5, planar portion 59 extends across the seams between roof board 12 and panels 32 (FIGS. 4 and 5) of the skylight main frame, thereby sealing those seams against leakage. In addition, gussets 6 close off and seal the spaces between the sides of the lower portion of the window and the skylight frame. Thus, should a deposit of ice or snow build up on ramp portion 64 (or shingles 13' covering it), so as to dam up water above such a deposit, gussets 61 will prevent any of the dammed up water from flowing past the sides of the window into the room below. Moreover, in the embodiment illustrated, reversely-folded portions 63 of the flashing serve as gaskets between the window pane and its frame. If desired, portions 63 could be eliminated, and the gussets attached to window 38 in some other fashion, such as by fastening the portions 70 of flashing 58 to the oppositely facing edge of strips 45. Alternatively, in place of reversely-folded portions 63, the portion of the flashing extending from portion 70 could be wrapped around the entire edge of pane 40 so as to be located between the pane and strip 45 as well as between the pane and strip 43.

Although flashing member 58 is a single piece, provision of gussets 61, capable of expanding and contracting, permits the window to be opened and closed without restraint. Moreover, even if dammed up water is resting upon the window at the time it is opened, gussets 61 will prevent the water from overflowing into the room below.

If the skylight is used in a location where it is not easily reached, any suitable means may be employed to open and close window 38, and to limit the opening movement of window 38. For example, an intermeshing worm and wormwheel, and a chain attached to the window could be used, as illustrated in the above-mentioned U.S. Pat. No. 4,610,116. Alternatively, an abutment projecting from one of the side members 14 could be located so as to be engaged by window 38 to limit the opening movement of the window.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. A skylight assembly for installation in an opening in the pitched roof of a building, comprising:

a window having an upper end, a lower end, and two sides, means for hinging the window at one of its ends with respect to the roof so that the window may be swung between a closed position and an open position, and a rubbery flashing member for maintaining a water-tight seal between the window and roof, the member including:

a planar portion for arrangement in a plane parallel to the plane of the roof, the planar portion extending along the hinged end and both sides of the window, a portion for attachment to each side of the window, and a gusset portion between each attachment portion and the planar portion for expanding and contracting as the window is opened and closed, respectively, the planar, attachment, and gusset portions of the flashing member being integrally formed as a single piece.

2. A skylight assembly as defined in claim 1, including a main frame adapted to be secured within the roof opening, the window being hinged to the main frame, and the planar portion of the flashing extending beyond the periphery of the main frame.

3. A skylight assembly as defined in claim 1, wherein the window includes a light-transmitting pane secured within a window frame, the attachment portion of the flashing member being sandwiched between the pane and the window frame.

4. A skylight assembly as defined in claim 1 wherein each gusset portion of the flashing member is accordion-folded.

5. A skylight assembly as defined in claim 1 wherein each gusset portion of the flashing member tapers toward the hinged end of the window when the window is open.

* * * * *